US008677579B2

(12) United States Patent
Talley

(10) Patent No.: US 8,677,579 B2
(45) **Date of Patent: *Mar. 25, 2014**

(54) SINGLE EYELET LACES WITH INTERLOCKING AGLETS AND METHODS OF LACING THE SAME

(71) Applicant: Timothy J. Talley, Buffalo, NY (US)

(72) Inventor: Timothy J. Talley, Buffalo, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/901,829

(22) Filed: May 24, 2013

(65) Prior Publication Data

US 2013/0255046 A1 Oct. 3, 2013

Related U.S. Application Data

(63) Continuation of application No. 12/773,230, filed on May 4, 2010, now Pat. No. 8,448,354.

(60) Provisional application No. 61/175,599, filed on May 5, 2009.

(51) Int. Cl.

| | |
|---|---|
| ***A43C 1/02*** | (2006.01) |
| ***A43C 7/04*** | (2006.01) |
| ***A43C 9/04*** | (2006.01) |
| ***A43C 11/22*** | (2006.01) |

(52) U.S. Cl.
USPC ..... 24/713.1; 24/575.1; 36/50.1; 36/51

(58) Field of Classification Search
USPC ..... 24/713.1, 575.1, 713, 715.3, 715.4; 36/50.1, 51
See application file for complete search history.

(56) References Cited

U.S. PATENT DOCUMENTS

| | | | | | |
|---|---|---|---|---|---|
| 542,432 | A | * | 7/1895 | Wilde | 24/713.1 |
| 1,970,152 | A | | 8/1934 | Strangler | |
| 2,097,877 | A | * | 11/1937 | Getmansky | 24/710.8 |
| 2,266,083 | A | * | 12/1941 | Rzepa | 24/712.4 |
| 2,839,804 | A | * | 6/1958 | Benoit | 24/301 |
| 4,144,621 | A | | 3/1979 | Green | |
| 4,733,439 | A | | 3/1988 | Gentry | |

(Continued)

FOREIGN PATENT DOCUMENTS

| | | |
|---|---|---|
| GB | 657958 | 10/1951 |

*Primary Examiner* — Ted Kavanaugh
(74) *Attorney, Agent, or Firm* — Ladas & Parry LLP

(57) ABSTRACT

A kit including (a) an article having a plurality of pairs of opposing eyelets, including a first pair of opposing eyelets near a top of the article and a second pair of opposing eyelets disposed beneath the first pair of opposing eyelets; (b) a first lace that is threadable through respective eyelets of the first pair of opposing eyelets and fixable at insides of the eyelets, said first lace having (i) a first elastic body; and (ii) one of a stop or openable stop on one end of the first body; and (iii) an openable stop on an opposite end of the first body; and (c) a second lace that is threadable through respective eyelets of the second pair of opposing eyelets and fixable at insides of the eyelets, said second lace having (i) a second elastic body; and (ii) one of a stop or openable stop on one end of the second body; and (iii) an openable stop on an opposite end of the second body; and wherein at least the openable stop on the opposite end of the first body can interlock with the openable stop on the opposite end of the second body with the first and second laces threaded through the first and second pair of eyelets respectively. Also, a method for using the kit.

4 Claims, 2 Drawing Sheets

(56) References Cited

U.S. PATENT DOCUMENTS

| | | | | |
|---|---|---|---|---|
| 7,036,194 | B2 | 5/2006 | Tricker | |
| 8,448,354 | B2 * | 5/2013 | Talley | 36/51 |
| 2009/0205175 | A1 * | 8/2009 | Han | 24/712.1 |
| 2009/0242439 | A1 * | 10/2009 | Talley | 206/338 |
| 2010/0293767 | A1 * | 11/2010 | Talley | 24/713.6 |
| 2010/0325849 | A1 * | 12/2010 | Clayton | 24/713.6 |
| 2012/0117819 | A1 * | 5/2012 | Atamian | 36/50.1 |
| 2012/0117820 | A1 * | 5/2012 | Atamian | 36/50.1 |

* cited by examiner

1/8"
Elasticized Shoe Lace Segment
12C

Stainless Steel Metal Tip with Lace Crimped Inside closed portion 16

12C
Elasticized Shoe Lace Segment
16

SINGLE EYELET LACES WITH INTERLOCKING AGLETS AND METHODS OF LACING THE SAME

CROSS REFERENCE APPLICATIONS

This application is a continuation of U.S. patent application Ser. No. 12/773,230 filed May 4, 2010 (now U.S. Pat. No. 8,448,354 issued May 28, 2013) which claims the benefit of Provisional Application 61/175,599 filed on May 5, 2009.

The contents of U.S. patent application Ser. No. 12/362,851 filed Jan. 30, 2009 are incorporated herein by reference.

FIELD OF INVENTION

The invention relates to single eyelet laces, which as used herein comprehends any elongated flexible members that extend between a single pair of eyelets of a shoe or garment, regardless of flat, round, or other cross section, and a method of lacing a shoe or garment therewith.

BACKGROUND OF INVENTION

It is known to thread a lace through eyelets with or without grommets thereabout in opposite sides of a shoe or garment to open and close a portion of the shoe or garment. Often, there are multiple eyelets on each side of the shoe or garment and the lace is crossed between them from one, e.g., toe end of the eyelets in a method called lacing, but using the lace between a single pair of eyelets on opposite sides of a shoe or garment is considered lacing as used herein.

Such lacing is limited in appearance by that of the lace and limited in utility by matching the lengths of the laces to the number of eyelets of the shoe or garment and, in criss crossing, keeping the ends of the lace even, for example.

Therefore, Tricker U.S. Pat. No. 7,036,194 of May 2, 2006, Head GB Patent 657,958 of Oct. 3, 1951, and Gentry U.S. Pat. No. 4,733,439 of Mar. 29, 1988, for example, have proposed laces for extending between a single pair of eyelets on opposite sides of a shoe to vary the appearance and improve the utility of laces. These laces have not found wide acceptance, perhaps because their appearance is unusual and their structures difficult to use.

SUMMARY OF INVENTION

To avoid such limitations, the inventor has invented single eyelet laces (hereinafter also called "U-lace"), each embodiment being an elongated flexible member the flexibility of which permits it to be flat, U-shaped, L-shaped or other bent, coiled or twisted shapes. In addition, U-shaped as used herein is generic for inversion (upside-down U-shape) or other orientations in use or C-shapes, where the ends may have fastening utility as may outward serifs on the ends of the U-shape that are also within the genus of the U-shape as used herein.

In the invention, there are a plurality of laces each of which has an elongated flexible elastic body, like a known shoe lace, for example, with an openable stop at least at one end and a stop that may or may not be openable at the other end. The openable stop opens to a size and/or shape that will not pass through an eyelet of the shoe or garment on which the lace is used and closes to a size that will. The openable stop of each of the plurality of lace scan interlock with an openable stop of other of the plurality of laces.

In a preferred embodiment there is provided a kit comprising:

(a) an article comprising a plurality of pairs of opposing eyelets, including a first pair of opposing eyelets near a top of the article and a second pair of opposing eyelets disposed beneath the first pair of opposing eyelets;

(b) a first lace that is threadable through respective eyelets of the first pair of opposing eyelets and fixable at insides of the eyelets, said first lace comprising (i) a first elastic body; and (ii) one of a stop or openable stop on one end of the first body; and (iii) an openable stop on an opposite end of the first body; and (c) a second lace that is threadable through respective eyelets of the second pair of opposing eyelets and fixable at insides of the eyelets, said second lace comprising (i) a second elastic body; and (ii) one of a stop or openable stop on one end of the second body; and (iii) an openable stop on an opposite end of the second body; and wherein at least the openable stop on the opposite end of the first body can interlock with the openable stop on the opposite end of the second body with the first and second laces threaded through the first and second pair of eyelets respectively.

These embodiments and the method of their use will be better understood from consideration of the accompanying figures that illustrate but do not limit the invention in which.

Figures 1, 2:
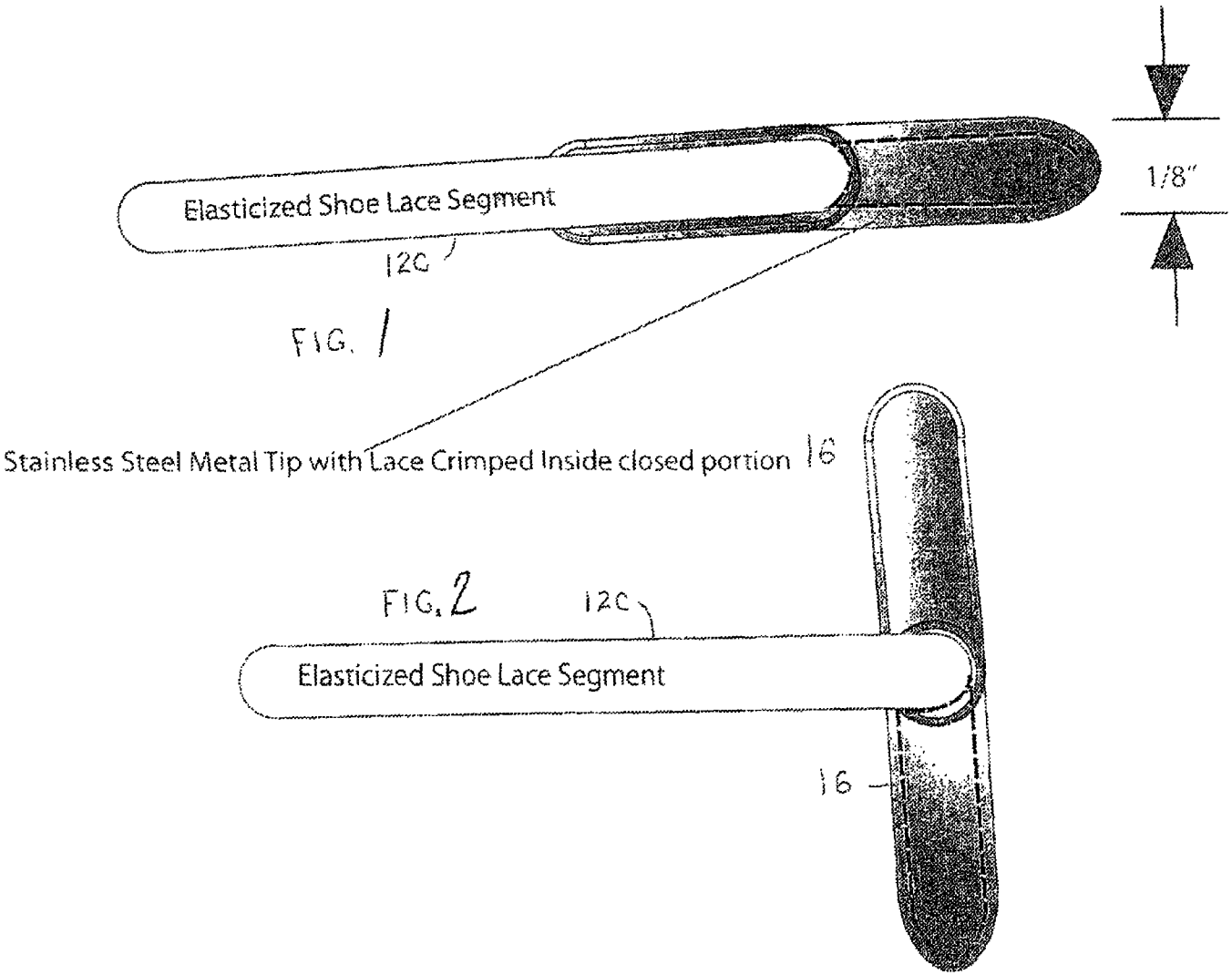
FIG. 1 is a plan view of an end portion of an openable stop in a closed condition.
FIG. 2 is a plan view of an end portion of an openable stop in an opened condition.

As shown in FIGS. 1 and 2, an end of the body 12C has a toggle stop. The round cross section of the body 12C that is shown may be varied, including flat. The toggle stop 16 can pivot from a position parallel to the body 12C for passing through an eyelet (not shown) of a shoe or garment as shown in FIG. 1 to a position transverse to the body 12C so as not to pass through the eyelet. The fixation of the end of the body 12C in the toggle stop 16 is shown by dashed lines. The toggle stop 16 may be made of stainless steel or other metal or plastic, for example.

A method of using this embodiment passes the toggle end through one eyelet of a shoe or garment inside to outside and through another eyelet outside to inside while the toggle stop is in the body-parallel position shown in FIG. 1. The toggle stop is then moved to the transverse position shown in FIG. 2 to hold the toggle stop 16 and one end of the body 12C inside the other eyelet while the stop 14 holds the other end of the body 12C inside the one eyelet. The elasticity of the body 12C may then pull the eyelets together when the eyelets are on opposite sides of a portion of the shoe or garment.

Figure 3:
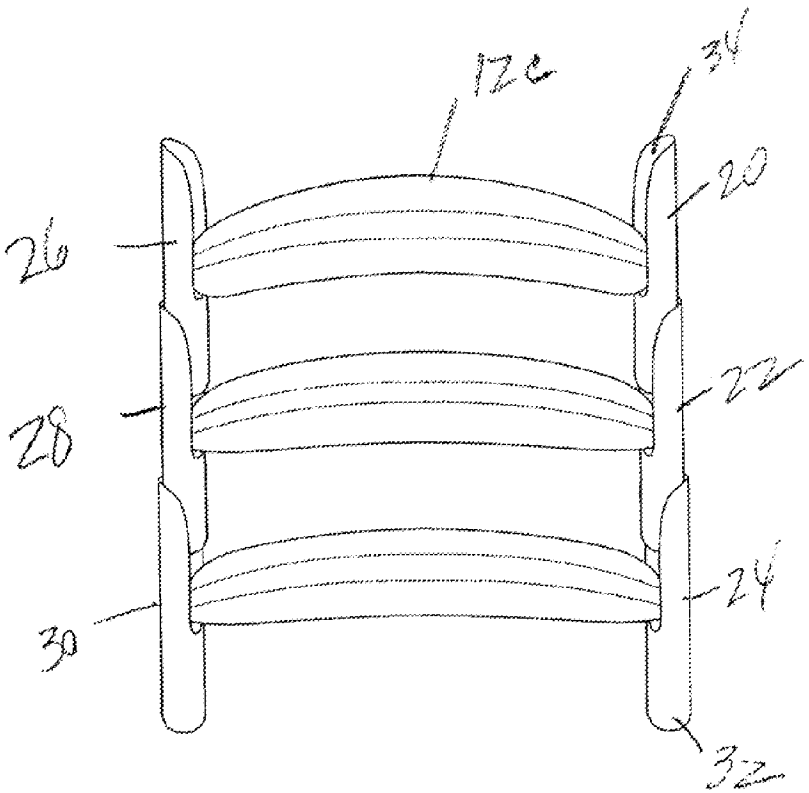
FIG. 3 is a plan view of a plurality of laces each having a plurality of openable stops in the closed position and interlocking with other openable stops.

There is now provided a description of the interlocking aglets on U-Lace with reference to FIG. 3.

The aglets/tips 20, 22, 24, 26, 28 and 30 on either end of each U-Lace segment 12C are formed in such a way to create a toggle with 2 different shapes/specification on either end as follows:

(a) one end 32 looks like a standard aglet on a standard shoelace; and (b) the other end 34 like a "tube" where sufficient of the aglet (e.g., about 40%) is cut away along its length to allow interlocking with another aglet.

These two different specifications on either end of the toggles combine to create an interlocking mechanism that is totally unique to U-Lace. The end of the toggle with cut-away portion has an internal shape and curvature that may be the same as the external shape and curvature of the end of the toggle with the standard aglet shape to facilitate interlocking or nesting.

U-Lace also possesses a specific orientation: there is a left side and a right side that makes the toggle turn in such a way under the eyelet to orient itself for nesting. As the shoe is laced with U-Lace segments, each newly inserted U-Lace segment toggle (standard aglet end) nests/interlocks under the preceding U-Lace segment toggle (cut away end) to form a single line of interlocked toggles that are oriented parallel to the direction of the foot.

The interlocking feature provides additional comfort to the wearer, as toggles that are not interlocked have been proven to rotate in any direction giving a non-uniform feel to the wearer and even discomfort to the wearer if the toggles become oriented perpendicular to the wearer's foot.

The invention in one embodiment thus provides a modular lacing system designed for the footwear industry.

The product comprises individual—discrete—segments of an elasticized tubular lace which has the ability to be locked into standard eyelets providing a laced look without having to actually lace the shoe in a traditional manner.

One benefit of the product from a fashion perspective is that each segment of lacing on the shoe can be a different color or pattern offering consumers the ability to customize their footwear.

The stretch also allows footwear to be put on and taken off without having to unlace or adjust the laces.

The product may be made up of 3 primary components:

1) Tubular elasticized lacing—this may be made to specification (weight, width, elasticity, color, etc).

2) Inner spine—This piece fits inside the tube of the elasticized lace and is not visible from the outside.

3) Toggle or stop.

A consumer lacing footwear with U-Lace would simply decide what look and color scheme he or she wanted for his or her shoes and take a segment of U-Lace and thread one end through an eyelet of the shoe; then slightly stretch it to the other eyelet and lock the toggle of the segment into that eyelet. The consumer would then interlock the toggles of adjoining lace segments. This process is repeated until the shoe is fully laced. A lace or laces may be threaded through a badge or badges further to customize a shoe according to a user's preference and to provide a customized display. The badge or badges may also be used with regular (non U-shape) laces to provide a customized display.

Since the fabric/lace forming the U-lace product is threaded through and under the eyelet the appearance of the shoe is that the product is actually laced and not just lace segments.

I claim:

1. A kit comprising a plurality of laces, including a first lace and a second lace, each of the first and second laces comprising (a) an elongate body; and (b) a toggle on at least one end of the elongate body that is rotatable from a first position in alignment with the elongate body to a second position that is transverse to the elongate body such that each of the first and second laces can be threaded through an eyelet of a shoe with the toggle in the first position and then rotated to the second position to maintain the lace threaded through the eyelet, wherein the respective toggles of the first and second laces comprise an end with a cut-away portion and an end with a tubular shape, wherein the end of each of the toggles with cut-away portion has an internal shape and curvature that is the same as an external shape and curvature of the end of each of the toggles with the tubular shape so as to facilitate interlocking between the end of the toggle with cut-away portion of the first lace and the end of the toggle with tubular shape of the second lace when the toggle of the first lace and the toggle of the second lace are threaded through adjacent eyelets of a shoe and in alignment with each other, the end of each of the toggles with cut-away portion being cut away along sufficient of its length to allow an interlocking between the toggles that prevents rotation of the toggles when interlocked.

2. The kit according to claim 1, wherein each of the first and second laces comprises a second toggle on an end of the elongate body that is opposite to the at least one end of the respective first and second laces, the second toggle of each of the respective first and second laces having the same shape as the toggle on the at least one end of the respective first and second laces.

3. The kit according to claim 1, wherein the end of each of the toggles with cut-away portion is cut away along about 40% of a length of the toggle.

4. The kit according to claim 2, wherein the end of each of the toggles with cut-away portion is cut away along about 40% of a length of the toggle.

* * * * *